US009359176B2

(12) United States Patent
Gao et al.

(10) Patent No.: US 9,359,176 B2
(45) Date of Patent: Jun. 7, 2016

(54) MOVEMENT DEVICE CONFIGURED FOR MOVING A PAYLOAD

(75) Inventors: Dalong Gao, Rochester, MI (US); Robert J. Scheuerman, Washington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 699 days.

(21) Appl. No.: 13/424,620

(22) Filed: Mar. 20, 2012

(65) Prior Publication Data

US 2013/0248477 A1 Sep. 26, 2013

(51) Int. Cl.
*B66C 13/08* (2006.01)

(52) U.S. Cl.
CPC ..... *B66C 13/08* (2013.01)

(58) Field of Classification Search
CPC .. B23Q 1/5406; B23Q 1/5412; B23Q 1/5418; B23Q 1/5443; B23Q 1/5468; B23Q 1/5475; B25J 3/04; B25J 5/04; B25J 9/003; B25J 9/0036; B25J 9/0042; B25J 9/0045; B25J 9/0048; B25J 9/0051; B25J 9/02; B25J 9/023; B25J 9/026; B25J 9/106; B25J 9/1065; B25J 9/1623; B25J 17/0216; B25J 17/0241; B25J 17/025; B25J 17/0258; B25J 17/0266; B25J 17/0275; B66C 5/02; B66C 5/04; B66C 13/08; B66C 19/00
USPC ..... 212/312, 317, 319, 321, 322, 323, 324, 212/326, 327; 414/191, 589, 590, 735, 738; 901/16, 18, 23
See application file for complete search history.

(56) References Cited

U.S. PATENT DOCUMENTS

| | | | | |
|---|---|---|---|---|
| 5,354,158 | A * | 10/1994 | Sheldon et al. | 409/201 |
| 5,987,726 | A * | 11/1999 | Akeel | 29/407.08 |
| 6,330,837 | B1 * | 12/2001 | Charles et al. | 74/490.06 |
| 6,378,190 | B2 * | 4/2002 | Akeel | 29/407.08 |
| 6,648,583 | B1 * | 11/2003 | Roy et al. | 414/735 |
| 6,719,506 | B2 * | 4/2004 | Chang et al. | 409/201 |
| 8,225,692 | B2 * | 7/2012 | Kock et al. | 74/490.03 |
| 8,333,766 | B2 * | 12/2012 | Edelhauser et al. | 606/58 |
| 2013/0112644 | A1 * | 5/2013 | Gao | B66C 17/00 212/312 |

FOREIGN PATENT DOCUMENTS

| | | | |
|---|---|---|---|
| CN | 2861111 | Y | 1/2007 |
| CN | 200958013 | Y | 10/2007 |
| CN | 201381177 | Y | 1/2010 |
| CN | 201923786 | U | 8/2011 |
| WO | 2006083231 | A1 | 8/2006 |

* cited by examiner

*Primary Examiner* — Saul Rodriguez
*Assistant Examiner* — Brendan Tighe
(74) *Attorney, Agent, or Firm* — Quinn Law Group, PLLC

(57) ABSTRACT

A movement device is configured for moving a payload. The movement device includes a first support, a second support, and an intermediate support. The intermediate support is operatively disposed between the first support and the second support. The intermediate support is jointed to the first support at two first joints and jointed to the second support at two second joints. The second support is configured for supporting the payload. The intermediate support is jointed to the second support at two second joints. The first joints are pivotable about a respective first axis of rotation such that the intermediate support moves relative to the first support. The second joints are pivotable about a respective first axis of rotation such that the second support moves relative to the intermediate support. Each of the first axes of rotation are in spaced and generally parallel relationship to one another.

17 Claims, 4 Drawing Sheets

MOVEMENT DEVICE CONFIGURED FOR MOVING A PAYLOAD

TECHNICAL FIELD

The present disclosure relates to a movement device that is configured for moving a payload.

BACKGROUND

Overhead bridge cranes are widely used to lift and relocate large payloads. Generally, the displacement in a pick and place operation involves three translational degrees of freedom and a rotational degree of freedom along a vertical axis. This set of motions, referred to as a Selective Compliance Assembly Robot Arm ("SCARA") motions or "Schönflies" motions, is widely used in industry. A bridge crane allows motions along two horizontal axes. With appropriate joints, it is possible to add a vertical axis of translation and a vertical axis of rotation. A first motion along a horizontal axis is obtained by moving a bridge on fixed rails while the motion along the second horizontal axis is obtained by moving a trolley along the bridge, perpendicularly to the direction of the fixed rails. The translation along the vertical axis is obtained using a vertical sliding joint or by the use of a belt. The rotation along the vertical axis is obtained using a rotational pivot with a vertical axis.

There are partially motorized versions of overhead bridge cranes that are displaced manually along horizontal axes and rotated manually along the vertical axis by a human operator, but that include a motorized hoist in order to cope with gravity along the vertical direction. Also, some bridge cranes are displaced manually along all of the axes, but the weight of the payload is compensated for by a balancing device in order to ease the task of the operator. Such bridge cranes are sometimes referred to as assist devices. Balancing is often achieved by pressurized air systems. These systems need compressed air in order to maintain pressure or vacuum—depending on the principle used—which requires significant power. Also, because of the friction in the compressed air cylinders, the displacement is not very smooth and can even be bouncy. Balancing can be achieved using counterweights, which add significant inertia to the system. Although helpful and even necessary for the vertical motion, such systems attached to the trolley of a bridge crane add significant inertia regarding horizontal motion due to moving the mass of these systems. In the case of balancing systems based on counterweights, the mass added can be very large, even larger than the payload itself. If the horizontal traveling speed is significant, the inertia added to the system becomes a major drawback.

There are also fully motorized versions of such bridge cranes that require powerful actuators, especially for the vertical axis of motion which has to support the weight of the payload. These actuators are generally attached to the trolley or bridge and are then in motion. The vertical translation actuator is sometimes attached to the bridge and linked to the trolley by a system similar to what is used in tower cranes.

SUMMARY OF THE DISCLOSURE

A movement device is configured for moving a payload. The movement device includes a first support, a second support, and an intermediate support. The intermediate support is operatively disposed between the first support and the second support. The intermediate support is jointed to the first support at two first joints and jointed to the second support at two second joints. The second support is configured for supporting the payload. The first joints are pivotable about a respective first axis of rotation such that the intermediate support moves relative to the first support. The second joints are pivotable about a respective second axis of rotation such that the second support moves relative to the intermediate support. Each of the first axes of rotation is in spaced relationship to each of the second axes of rotation.

In another aspect of the disclosure, a movement device is configured for moving a payload. The movement device includes a trolley, a first support a second support, an intermediate support, and a locking mechanism. The trolley is configured for movement along a Y axis. The first support operatively extends from the trolley. The intermediate support is operatively disposed between the first support and the second support. The intermediate support is jointed to the first support at two first joints and jointed to the second support at two second joints. The second support is configured for supporting the payload. The second support is configured to move relative to the first support about the joint. The first joints are pivotable about a respective first axis of rotation such that the intermediate support moves relative to the first support. The second joints are pivotable about a respective second axis of rotation such that the second support moves relative to the intermediate support. The locking mechanism is configured for moving between a locked position and an unlocked position. The second support is fixed relative to the first support when the locking mechanism is in the locked position. The second support is movable relative to the first support when the locking mechanism is in the unlocked position.

In yet another aspect of the disclosure, a movement device is configured for moving a payload. The movement device includes a trolley, a first support, a second support, an intermediate support, an end effector, and a locking mechanism. The trolley is configured for movement along a Y axis. A first support operatively extends from the trolley and is configured for movement along a Z axis. The intermediate support is operably disposed between the first support and the second support. The intermediate support is jointed to the second support at two second joints. The first joints are pivotable about a respective upper first axis of rotation such that the intermediate support moves relative to the first support. The second joints are pivotable about a respective lower first axis of rotation such that the second support moves relative to the intermediate support. The end effector rigidly extends from the second support and is configured for supporting the payload. The locking mechanism is configured for moving between a locked position and an unlocked position. The second support is fixed relative to the first support when the locking mechanism is in the locked position. The second support is movable relative to the first support when the locking mechanism is in the unlocked position.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Referring now to the figures, which are exemplary embodiments and wherein like elements are numbered alike.

DESCRIPTION OF THE PREFERRED EMBODIMENTS

Figure 1:
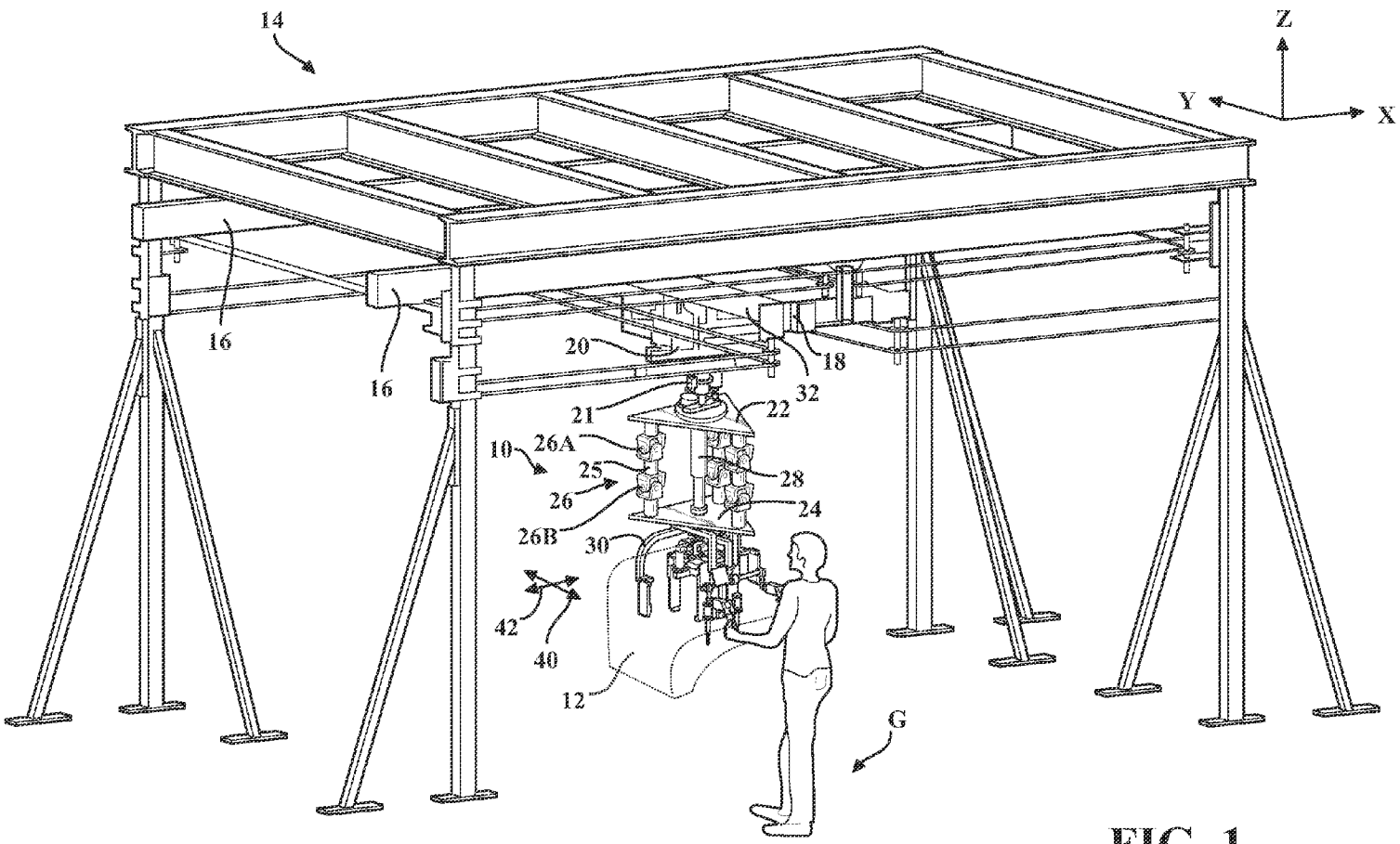
FIG. 1 is a schematic perspective view of an movement device mounted to a support structure.

Referring to the drawings, wherein like reference numbers refer to like components, a movement device configured for moving a payload 12 in a plurality of directions is shown at 10 in FIG. 1. The movement device 10 is mounted to a support structure 14 that supports the movement device 10 and the payload 12. The support structure 14 includes, but is not limited to a pair of parallel rails 16 or runway tracks.

The movement device 10 includes a bridge crane 18, a trolley 20, a support portion 21 a first support 22, a second support 24, an intermediate support 25, first joints 26A, second joints 26B, a locking mechanism 28, and an end effector 30. The bridge crane 18 is a structure that includes at least one girder 32 that spans the pair of parallel rails 16. The bridge crane 18 is adapted to carry the payload 12 along an X axis. The trolley 20 is movably attached to the girders 32 of the bridge crane 18 such that the trolley 20 is adapted to carry the payload 12 along a Y axis, in generally perpendicular relationship to the X axis. The support portion 21 operatively extends from the trolley 20 along a Z axis. The Z axis extends in perpendicular relationship to the X axis and the Y axis, i.e., in a generally vertical direction relative to the ground G. The first support 22 operatively extends from the support portion 21. The intermediate support 25 is operatively disposed between the first support 22 and the second support 24. The intermediate support 25 is jointed to the first support 22 at two first joints 26A and jointed to the second support 24 at two second joints 26B. The end effector 30 is operatively attached to the second support 24 such that the end effector 30 is movable in a generally horizontal plane, relative to the first support and the trolley 20 via the first and second joints 26A, 26B. Therefore, the second support 24 is configured for supporting the payload 12 and is movable relative to the first support 22 at the first and second joints.

Referring generally to FIGS. 2-5, the payload 12 is allowed to move relative to the trolley 20 by virtue of the second support 24 moving relative to the first support 22 at the joints 26A, 26B. The first joints 26A are pivotable about a respective first axis of rotation 34A and a respective second axis of rotation 36A such that the intermediate support 25 moves relative to the first support 22. The second joints 26B are also pivotable about a respective first axis of rotation 34B and a respective second axis of rotation 36B such that the second support 24 moves relative to the intermediate support 25. Each of the first axes of rotation 34 are in spaced and generally parallel relationship to one another. Further, referring to FIGS. 1-5, each of the first axes of rotation 34A, 34B are perpendicular to each of the second axes of rotation 36A, 36B. The combination of the first and second joints 26A, 26B provides two degrees of freedom (DOF) between the second support 24 and the first support 22. The second support 24 moves relative to the first support 22 in a first horizontal direction 40, relative to the ground G, in response to the first and/or second joints 26A, 26B pivoting about the respective first axes of rotation 34A, 34B. Likewise, the second support 24 moves relative to the first support 22 in a second horizontal direction 42, relative to the ground G, in response to the first and/or second joints 26A, 26B pivoting about the respective second axes of rotation 36A, 36B.

Figure 2:
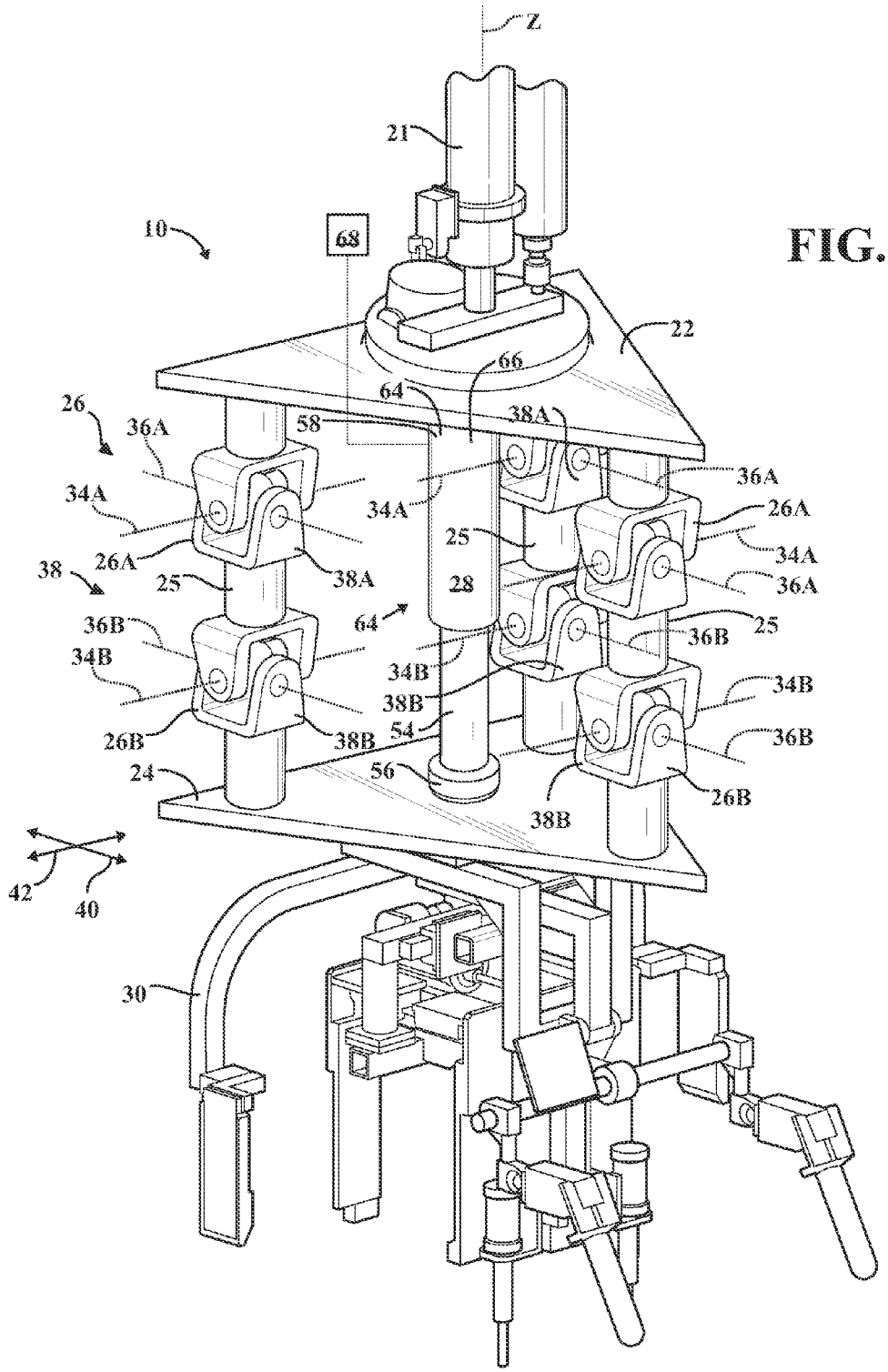
FIG. 2 is a schematic perspective view of the movement device of FIG. 1, configured for maneuvering a payload.
Figure 3:
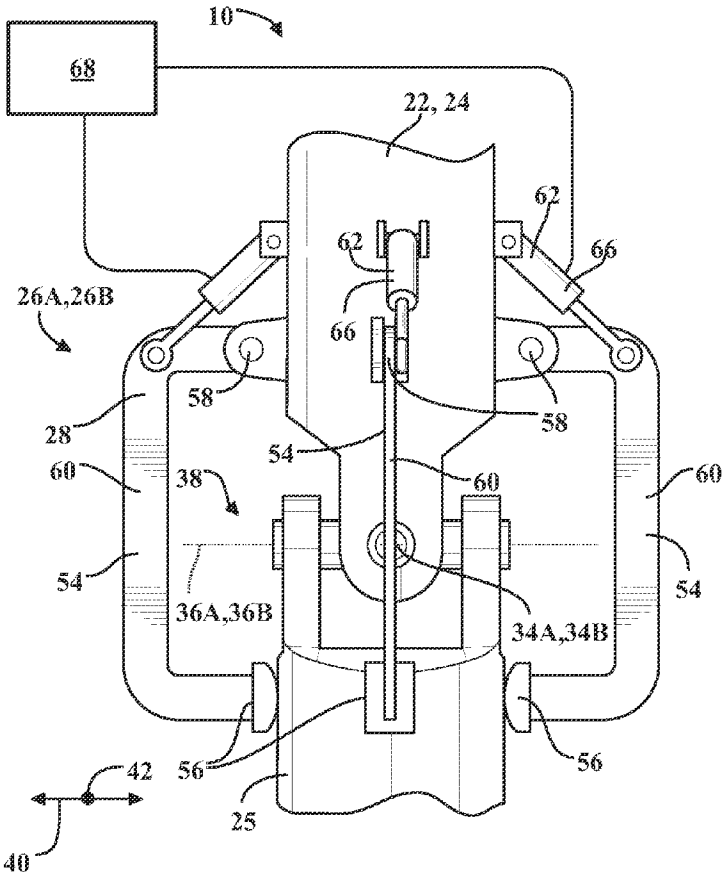
FIG. 3 is a schematic side view of one of the joints of the movement device of FIG. 2, illustrating a locking mechanism.

Referring specifically to FIGS. 1-3, the first and second joints 26A, 26B may be universal joints 38. More specifically, the universal joints 38 include three first universal joints 38A, three second universal joints 38B, and three intermediate supports 25. Each of the first universal joints 38A presents an upper first axis of rotation 34A and an upper second axis of rotation 36A. Each of the second universal joints 38B presents a lower first axis of rotation 34B and a lower second axis of rotation 36B. Each of the upper and lower first axes of rotation 34A, 34B extends in spaced and generally parallel relationship to one another. Likewise, each of the upper and lower second axes of rotation 36A, 36B extends in spaced and generally parallel relationship to one another. Additionally, each of the upper and lower first axes of rotation 34A, 34B extends in generally perpendicular relationship to each of the upper and lower second axes of rotation 36A, 36B. Further, one of the intermediate supports 25 is disposed between a respective first universal joint 38A and a corresponding second universal joint 38B. Therefore, as the second support 24 moves relative to the ground G in the first horizontal direction and/or the second horizontal direction, each of the intermediate supports 25 move in unison with one another such that the intermediate supports 25 remain in parallel relationship with one another. Further, the first support 22 and the second support 24 remain in spaced and parallel relationship to one another as the second support 24 moves relative to the first support 22 in the first and/or second horizontal directions 40, 42.

Figure 4:
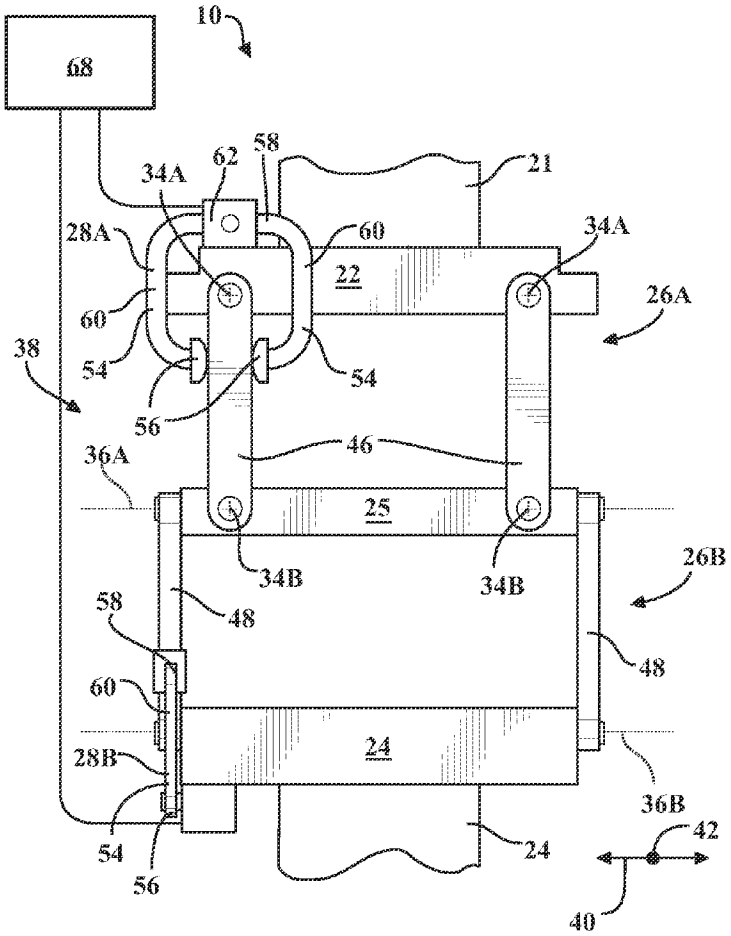
FIG. 4 is a schematic side view of another embodiment of the joint of the movement device of FIG. 1.
Figure 5:
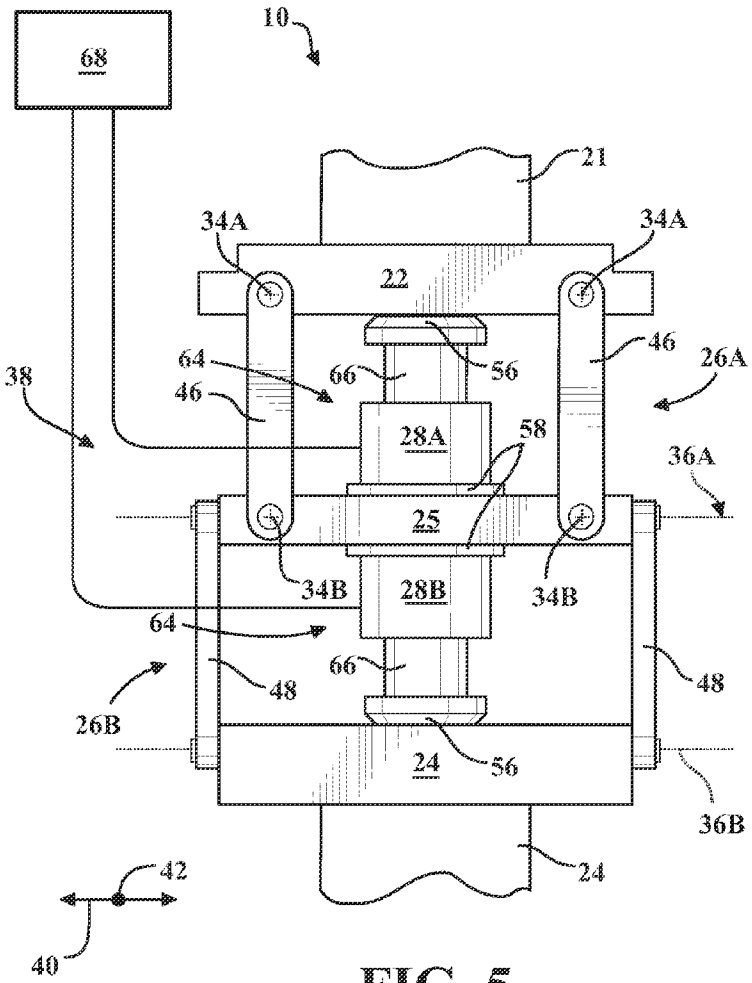
FIG. 5 is a schematic side view of yet another embodiment of the joint of the movement device of FIG. 1.

Referring to FIGS. 4 and 5, the movement device 10 includes the first support 22, the second support 24, and the intermediate support 25 disposed between the first support 22 and the second support 24. A pair of first linkages 46 pivotally extends between the first support 22 and the intermediate support 25. Each of the first linkages 46 extends in spaced and parallel relationship to one another and is pivotally attached to the first support 22 and the intermediate support 25. Therefore, each of the first axes of rotation 34A, 34B are in spaced and parallel relationship to one another. The intermediate support 25 moves with respect to the first support 22 by virtue of each of the first linkages 46 pivoting relative to the respective first support 22 about a respective upper first axis of rotation 34A and pivoting relative to the intermediate support 25 about a respective lower first axis of rotation 34B. Therefore, the first support 22 and the intermediate support 25 remain in spaced and parallel relationship to one another as the intermediate support 25 moves relative to the first support 22 in the first horizontal direction 40.

A pair of second linkages 48 pivotally extends between the second support 24 and the intermediate support 25. Each of the second linkages 48 extends in spaced and parallel relationship to one another and is pivotally attached to each of the second support 24 and the intermediate support 25. More specifically, the second linkages 48 extend between the second support 24 and the intermediate support 25 such that each of the second axes of rotation 36 are in spaced and parallel relationship to one another. The second support 24 moves with respect to the intermediate support 25 by virtue of each of the second linkages 48 pivoting relative to the intermediate support 25 about a respective upper second axis of rotation 36A and pivoting relative to the second support 24 about a lower second axes of rotation 36B. Therefore, the second support 24 and the intermediate support 25 remain in spaced and parallel relationship to one another as the second support 24 moves in the second horizontal direction 42. The first axes of rotation 34A, 34B are generally perpendicular to the second axes of rotation 36A, 36B to provide two degrees of freedom. Additionally, the intermediate support 25 and the second support 24 remain in spaced and parallel relationship to one another as the second support 24 moves relative to the intermediate support 25 in the second horizontal direction 42.

With continued reference to FIGS. 4 and 5, it should be appreciated that more than two first and/or second linkages 46, 48 may be used to provide additional stability between the respective supports 22, 24, 25.

Figure 6:
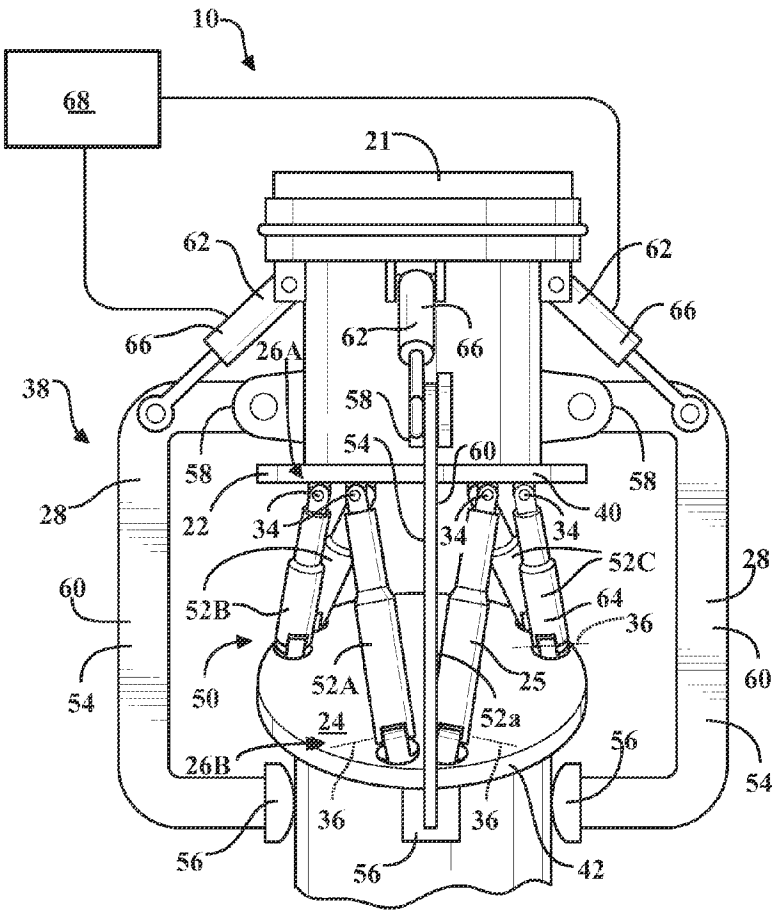
FIG. 6 is a schematic side view of another embodiment of the joint of the movement device of FIG. 1.

Referring to FIG. 6, the movement device 10 may be configured to include a hexapod 50, such as a Gough/Stewart platform. More specifically, the movement device 10 includes the first support 22 and the second support 24. A plurality of intermediate supports 25 are operatively disposed between the first support 22 and the second support 24. The intermediate supports 25 are a pair of first, second, and third linear actuators 52A, 52B, 52C that provide a total of six linkages which respectively link the first support 22 and the second support 24. More specifically, each pair of linear actuators 52A, 52B, 52C is pivotally attached to the first support 22 at a respective first joint 26A and is pivotally attached to the second support at a respective second joint 26B. Each first joint 26A is configured to pivot about respective first axes of rotation 34 and each second joint 26B is configured to pivot about respective second axes of rotation 36. Each joint 26A, 26B may also be universal joints that each allow the respective joint 26A, 26B to pivot about first and second axes of rotation 34, 36. These six actuators 52A, 52B, 52C provide six degrees of freedom. More specifically, each actuator 52A, 52B, 52C may provide a telescoping joint 64 that is configured to move telescopically. Therefore, the hexapod 50 may be configured such that the second support 24 is movable in all three linear movements X, Y, Z (lateral, longitudinal, and vertical) and the three rotations (pitch, roll, and yaw).

There may be times when operating the movement device 10 that it is necessary to prevent the second support 24 from pivoting relative to the first support 22. In order to prevent this pivoting movement, the locking mechanism 28 is configured for moving between a locked position and an unlocked position. The second support 24 is fixed relative to the first support 22 when the locking mechanism 28 is in the locked position. Likewise, the second support 24 is movable relative to the first support 22 about the joint mechanism 26 when the locking mechanism 28 is in the unlocked position.

Referring to FIGS. 3-6, the locking mechanism 28 includes an engagement mechanism 54 that extends to a locking end 56. The engagement mechanism 54 is configured to move between the locked position and the unlocked position. FIGS. 2, 3, and 6 show that the locking end 56 engages, or otherwise contacts, the second support 24 when the engagement mechanism 54 is in the locked position in order to fix the first support 22 relative to the second support 24. It should be appreciated that the locking end 56 may also engage the first support 22 when the engagement mechanism 54 is in the locked position. As a result, the second support 24 is prevented from moving relative to the first support 22 when the engagement mechanism 54 is in the locked position. The locking end 56 is configured to be disengaged from the second support 24 when the engagement mechanism 54 is in the unlocked position to allow the second support 24 to move relative to the first support 22.

With continued reference to FIGS. 2-6, the engagement mechanism 54 extends to an attachment end 58 that is disposed in spaced relationship to the locking end 56. With specific reference to FIGS. 2, 3, and 6, the engagement mechanism 54 is operatively attached to the first support 22 at the attachment end 58 such that the locking end 56 moves relative to the first support 22 between the locked position and the unlocked position.

Referring to FIG. 2, the locking mechanism 28 is operatively attached to the first support 22 at the attachment end 58 such that the engagement mechanism 54 and the engagement end 56 extend toward the second support 24. The locking end 56 of the engagement mechanism 54 is configured for operatively engaging the second support 24 when the engagement mechanism 54 is in the locked position. The locking mechanism 28 may include a telescopic joint 64 such that the locking end 56 of the respective locking mechanism 28 moves linearly, relative to the attachment end 58. When the telescopic joint 64 is in the locked position, the locking end 56 extends to the respective support 22, 24, 25 such that the telescopic joint 64 is in tensioned relationship between the second support 24 and/or the first support 22. The engagement mechanism 54 may include a hydraulic cylinder 66.

Referring to FIGS. 3, 4, and 6, the engagement mechanism 54 may be generally c-shaped. More specifically, the engagement mechanism 54 may be a pair of opposing c-shaped clamps 60 that each extends between the respective attachment end 58 and the respective locking end 56. Each c-shaped clamp 60 may be pivotally attached to one of the first or second supports 22, 24 such that each c-shaped clamp 60 pivots at the attachment end 58. Referring to FIGS. 3 and 6, the c-shaped clamp 60 is pivotally attached to the first support 22. With further reference to FIG. 3, two of the pairs of opposing c-shaped clamps 60 are disposed in generally perpendicular relationship to one another such that each of the pairs of c-shaped clamps 60 engages the intermediate support 25 when in the locked position to prevent the intermediate support 25 from pivoting relative to the first support 22 about both of the first axis of rotation 34 and the second axis of rotation 36. It should be appreciated that the c-shaped clamp 60 is not limited to being attached to the first and second supports 22, 24, but may also be attached to the intermediate support 25 such that the locking ends 56 engage the respective first support 22 and/or second support 24 when in the locked position. With reference to FIG. 4, the c-shaped clamp 60 is pivotally attached to each of the first and second supports 22, 24 such that the locking ends 56 engage the respective link 46, 48 when in the locked position. This engagement prevents the link 46, 48 from pivoting relative to the corresponding supports 22, 24, 25 to also prevent the supports 22, 24, 25 from moving relative to one another.

Further, a locking actuator 62 may be operatively attached to each c-shaped clamp 60. More specifically, referring to FIGS. 3 and 6, each locking actuator 62 operatively attaches the c-shape clamps 60 and the first support 22. Referring to FIG. 3, the locking actuator 62 operatively attaches the c-shaped clamps 60 and the respective first support 22 or second support 24. The locking actuator 62 is configured to pivotally move the c-shaped clamps 60 between the locked position and the unlocked position. Referring specifically to FIG. 3, when the c-shaped clamps 60 are in the locked position, the intermediate support 25 is restrained between the locking ends 56 of the c-shaped clamps 60 to prevent rotation of the intermediate support 25, relative to the respective first support 22 or second support 24, about at least one of the first and second axis of rotation 34A, 34B, 36A, 36B. Referring to FIG. 6, when the c-shaped clamps 60 are in the locked position, the second support 24 is restrained between the locking ends 56 of the c-shaped clamps 60 to prevent any motion of the second support 24.

Referring to FIGS. 4 and 5, the locking mechanism 28 includes a first locking mechanism 28A and a second locking mechanism 28B. Referring specifically to FIG. 4, the first locking mechanism 28A is pivotally attached to the first support 22 and the second locking mechanism 28B is pivotally attached to the second support 24. As described above, the locking ends 56 of the first locking mechanism 28A are configured to restrain a respective one of the pair of first linkages 46 therebetween when the first locking mechanism 28A is in the locked position and configured to release the respective one of the pair of first linkages 46 when the first locking mechanism 28A is in the unlocked position. Likewise, the locking ends 56 of the second locking mechanism 28B are configured to restrain a respective one of the pair of second linkages 48 therebetween when the second locking mechanisms 28B is in the locked position and configured to release the respective one of the pair of second linkages 48 when the second locking mechanism 28B is in the unlocked position. It should be appreciated that the first locking mechanism 28A and the second locking mechanism 28B may be actuated independent of one another. By way of a non-limiting example, the first locking mechanism 28A may be actuated such that rotation about the first axes of rotation 34 is prevented while still allowing rotation about the second axes of rotation 36 such that the intermediate support 25 is prevented from moving in the first horizontal direction 40. Alternatively, the first locking mechanism 28A and the second locking mechanism 28B may be configured to be actuated in unison.

Referring to FIG. 5, the first locking mechanism 28A and the second locking mechanism 28B are operatively attached to the intermediate support 25. The first and second locking mechanisms 28A, 28B are configured to independently move between a locked position and unlocked position. The first locking mechanism 28A and the second locking mechanism 28B may be operatively attached to the intermediate support 25 such that the respective attachment ends 58 are disposed on the intermediate support 25 in opposition to one another. The locking end 56 of the first locking mechanism 28A is configured to operatively engage the first support 22 when the first locking mechanism 28A is in the locked position. The locking end 56 of the second locking mechanism 28B is configured to operatively engage the second support 24 when the second locking mechanism 28B is in the locked position. More specifically, the first locking mechanism 28A and the second locking mechanism 28B may include a telescopic joint 64 such that the locking end 56 of the respective locking mechanism 28A, 28B moves linearly, relative to the attachment end 58. When the telescopic joint 64 is in the locked position, the locking end 56 extends to the respective support such that the telescopic joint 64 is in tensioned relationship between the intermediate support 25 and the respective support 22, 24. The locking mechanism 28A, 28B may include a hydraulic cylinder 66.

Referring to the Figures, the movement device 10 may include a controller 68. The controller 68 may be operatively connected to the linear actuators 62 or the cylinder 66. The controller 68 is configured to selectively control actuation of the linear actuators 62 to selectively move the respective locking mechanism 28 between the locked position and unlocked position.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A movement device configured for moving a payload, the movement device comprising:

a first support;

a second support;

three intermediate supports, each operatively disposed between the first support and the second support;

wherein each of the three intermediate supports is jointed to the first support at a respective pair of first joints and jointed to the second support at a respective pair of second joints;

wherein the second support is configured for supporting the payload;

wherein one of each pair of the first joints is pivotable about a respective upper first axis of rotation such that the respective intermediate support is movable relative to the first support;

wherein the other one of each pair of the first joints is pivotable about a respective upper second axis of rotation such that the respective intermediate support is movable relative to the first support;

wherein one of each pair of the second joints is pivotable about a respective lower first axis of rotation such that the second support is moveable relative to each of the intermediate supports;

wherein the other one of each pair of the second joints is pivotable about a respective lower second axis of rotation such that the second support is moveable relative to each of the intermediate supports;

wherein each of the upper and lower first axes of rotation extend in spaced and generally parallel relationship to one another;

wherein each of the upper and lower second axes of rotation extend in spaced and generally parallel relationship to one another;

wherein each of the upper and lower first axes of rotation are in spaced and generally perpendicular relationship to each of the upper and lower second axes of rotation such that the second support is moveable relative to the first support in only two degrees of freedom;

wherein the second support is movable relative to the first support in a first horizontal direction, relative to the ground, in response to each of the two first joints, corresponding to each of the three intermediate supports, pivoting about the respective first axes of rotation;

wherein the second support is movable relative to the first support in a second horizontal direction, relative to the ground, in response to each of the two second joints, corresponding to each of the three intermediate supports, pivoting about the respective second axes of rotation; and wherein the movement of the second support in the first horizontal direction is perpendicular to the movement of the second support in the second horizontal direction.

2. A movement device, as set forth in claim 1, wherein each of the three pairs of first joints is a respective first universal joint and each of the three pairs of second joints is a respective second universal joint;

wherein each of the first universal joints presents the upper first axis of rotation and the upper second axis of rotation;

wherein each of the second universal joints presents the lower first axis of rotation and the lower second axis of rotation.

3. A movement device, as set forth in claim 2, wherein each one of the three intermediate supports is disposed between a respective one of the three first universal joints and a respective one of the three second universal joints; and wherein the three intermediate supports move in unison with one another as the second support moves relative to the ground in at least one of the first horizontal direction and the second horizontal direction.

4. A movement device, as set forth in claim 1, further comprising a locking mechanism configured for moving between a locked position and an unlocked position;

wherein the second support is fixed relative to the first support when the locking mechanism is in the locked position; and wherein the second support is movable relative to the first support when the locking mechanism is in the unlocked position.

5. A movement device, as set forth in claim 4, wherein the locking mechanism includes an engagement mechanism extending to a locking end;

wherein the engagement mechanism is configured to move between the locked position and the unlocked position;

wherein the locking end is configured to engage one of the first and second supports when the engagement mechanism is in the locked position to fix the first support relative to the second support such that the first support is prevented from moving relative to the second support about one of the first and second joints; and wherein the locking end is configured to be disengaged from the one of the first and second supports when the engagement mechanism is in the unlocked position to allow the second support to move relative to the first support about the one of the first and second joints.

6. A movement device, as set forth in claim 5, wherein the engagement mechanism extends to an attachment end disposed in spaced relationship to the locking end; and wherein the attachment mechanism is operatively attached to the other one of the first and second supports at the attachment end such that the locking end moves relative to the other one of the first supports between the locked position and the unlocked position.

7. A movement device, as set forth in claim 5, wherein the engagement mechanism includes a telescopic joint.

8. A movement device, as set forth in claim 5, wherein the engagement mechanism is generally c-shaped.

9. A movement device, as set forth in claim 8, wherein the engagement mechanism includes a pair of c-shaped clamps disposed in opposing relationship to one another.

10. A movement device, as set forth in claim 5, wherein the locking mechanism further includes a locking actuator operatively connected to the engagement mechanism and configured to be actuated to move the engagement mechanism between the locked position and the unlocked position.

11. A movement device, as set forth in claim 10, wherein the locking actuator is one of a pneumatic cylinder and a hydraulic cylinder.

12. A movement device, as set forth in claim 8, wherein the locking mechanism further includes a controller operatively connected to the locking actuator and configured to selectively control actuation of the actuator.

13. A movement device configured for moving a payload, the movement device comprising:

a first support;

a second support;

an intermediate support operatively disposed between the first support and the second support;

wherein the second support is configured for supporting the payload;

wherein the intermediate support is movable relative to the first support;

a pair of first linkages pivotally extending between the first support and the intermediate support;

wherein each of the pair of first linkages extends in spaced and parallel relationship to one another and are pivotally attached to the first support at a respective upper first axis of rotation and are pivotally attached to the intermediate support at a lower first axis of rotation;

a pair of second linkages pivotally extending between the intermediate support and the second support;

wherein each of the pair of second linkages extends in spaced and parallel relationship to one another and are pivotally attached to the intermediate support at an upper second axis of rotation and are pivotally attached to the second support at a lower second axis of rotation;

wherein each of the upper and lower first axes of rotation extend in spaced and generally parallel relationship to one another;

wherein each of the upper and lower second axes of rotation extend in spaced and generally parallel relationship to one another; and wherein each of the upper and lower first axes of rotation extend in generally perpendicular relationship to each of the upper and lower second axes of rotation such that the second support is moveable relative to the first support in only two degrees of freedom.

14. A movement device, as set forth in claim 13, wherein the first support remains in parallel relationship to the second support as the second support moves relative to the first support.

15. A movement device, as set forth in claim 13, further comprising a locking mechanism configured for moving between a locked position and an unlocked position;

wherein the second support is fixed relative to the first support when the locking mechanism is in the locked position; and wherein the second support is movable relative to the first support when the locking mechanism is in the unlocked position.

16. A movement device, as set forth in claim 15, wherein the locking mechanism is a first locking mechanism and a second locking mechanism;

wherein the first and second locking mechanisms each extend to a locking end;

wherein the first and second locking mechanisms are configured to independently move between a respective locked position and unlocked position;

wherein the locking end of the first locking mechanism is configured for operatively engaging a respective one of the pair of first linkages when the first locking mechanism is in the locked position; and wherein the locking end of the second locking mechanism is configured for operatively engaging a respective one of the pair of second linkages when the second locking mechanism is in the locked position.

17. A movement device, as set forth in claim 1, wherein the first support remains in parallel relationship to the second support as the second support moves relative to the first support.

* * * * *